US005146864A

United States Patent [19]

Harrington

[11] Patent Number: 5,146,864

[45] Date of Patent: Sep. 15, 1992

[54] VARIABLE LENGTH BATTEN

[75] Inventor: Ross Harrington, Victoria, Canada

[73] Assignee: Venturi Designs Ltd., Victoria, Canada

[21] Appl. No.: 686,105

[22] Filed: Apr. 16, 1991

[51] Int. Cl.[5] ..... B63H 9/04

[52] U.S. Cl. ..... 114/103; 114/39.2

[58] Field of Search ..... 114/39.2, 102, 103, 114/89, 97, 109

[56] References Cited

U.S. PATENT DOCUMENTS

| | | | |
|---|---|---|---|
| 4,369,724 | 1/1983 | Weiss | 114/39.2 |
| 4,686,921 | 8/1987 | Magnan | 114/102 |
| 5,012,755 | 5/1991 | Lockhart et al. | 114/103 |

FOREIGN PATENT DOCUMENTS

| | | | |
|---|---|---|---|
| 2551022 | 3/1985 | France | 114/97 |

*Primary Examiner*—Edwin L. Swinehart
*Attorney, Agent, or Firm*—Townsend and Townsend

[57] ABSTRACT

A telescopic, flexible sail batten for a mast supported sail comprises first and second batten elements, each of the elements having first and second ends, the second end of the first element and the first end of the second element being nested for telescopic, free-sliding relative movement between extended and retracted positions. A helical coil spring is mounted longitudinally in the batten and acts on the first and second elements of the batten to bias the elements toward an extended position. A container having an aperture at a first end thereof, for slidably receiving the first end of the second batten element, is inserted in the open end of a longitudinal bore in the second end of the first batten element. The spring is mounted longitudinally in the container. The magnitude of the biasing force of the spring may be controllably adjusted by a screw slidably longitudinally mounted through a second aperture in an opposed end of the container from the first end of the container, the screw threadably cooperating with the first end on the second batten element.

36 Claims, 3 Drawing Sheets

B
B
8
11
7
4
2
17
6
5
17
1

11
4
7
2
17
6
5
17
1

8
10
11
4
7
4
7
2
17
6
5
17
1

VARIABLE LENGTH BATTEN

FIELD OF THE INVENTION

This invention relates to the field of battens for mast supported sails, and in particular, to the field of sail battens for sailboards.

BACKGROUND OF THE INVENTION

The use of battens to stiffen and add shape to mast-supported sails is well-known in the art of sailing, and in particular in the art of windsurfing. As an example, U.S. Pat. No. 1,362,950, Ljungström, issued Dec. 21, 1920, teaches permanently curved, somewhat flexible battens which hang in conventional batten pockets.

Batten pockets are merely long thin pockets manufactured into the sail which extend generally longitudinally along the sail chord between the leading and trailing edges of the sail. Usually a small batten pocket opening is provided through which long flexible beams called battens are inserted into the sail. A sail will conventionally have a plurality of battens extending in spaced array between the foot and head of the sail. The shape of a conventional sail is controlled by varying the tension on the sail rigging (that is, the downhaul, outhaul, boom-vang, and mainsheet) and by varying the batten length. The present invention is concerned with the latter.

Specifically, the present invention addresses a means for producing an efficient airfoil shape in a sail by the use of battens. In the prior art, three methods have been employed to control sail shape by using battens: (1) varying the length of the batten in the batten pocket; (2) tapering or otherwise increasing the flexibility of the forward end of the batten; and, (3) adding a bracket, called a camber-inducer, onto the forward end of the batten, between the batten and the mast.

One embodiment for varying batten length found in the prior art is the threaded length adjustment means illustrated in FIG. 5 of the Ljungström patent wherein threaded cap 7 screws onto the threaded trailing edge of the batten so as to allow for adjustment of the batten length between receiving members 6.

A common means for adjusting the length of the batten residing within the batten pocket, hereinafter referred to as "tensioning" the battens, is to have the batten extend aft out of the batten pocket, beyond the trailing edge of the sail. Various adjustable tensioning means mounted on the sail, such as strings or cranks, are then attached to the batten so that, when adjusted, they force more or less of the batten into the batten pocket.

Various batten constructions, including means for tensioning the battens in the batten pockets are taught in the prior art. International patent application Ser. No. PCT/GB89/00489, Paul, filed May 9, 1989 teaches a ratchet locking mechanism for tensioning otherwise conventional battens into batten pockets. U.S. Pat. No. 4,335,669, Hackney, issued Jun. 22, 1982 teaches the use of a jam cleat at the trailing end of the batten for tensioning the batten in the batten pocket.

Conventional battens are made out of bamboo, fibre glass or similar flexible material. They are typically cut to predetermined lengths. Shorter battens are interchanged for slightly longer battens in light wind conditions when the battens are relied upon to retain the airfoil shape of the sail. Often, as stated above, the battens are tapered so that the forward end of the batten is more flexible than the aft end. This, in turn, creates a more effective airfoil shape in the sail when the batten is tensioned into the batten pocket, in that increased curvature is introduced towards the leading edge of the sail.

Typical efficient airfoil shapes have their centre of lift at approximately the quarter chord as measured in from the leading edge. Consequently, various attempts have been made to shift the apex of curvature of the batten (the point of maximum sail draft) forward from the half chord point where, otherwise, the apex would normally reside, to the quarter chord point. Sail draft is defined as the orthogonal distance measured from the windward surface of the sail to a datum line (the chord line) extending between the leading and trailing edges of the sail.

The use of camber-inducers or split battens (battens having longitudinally split forward ends for engaging both the leeward and windward sides of a mast) alone, as taught in the prior sailboarding art, results in flat airfoils. Their use merely reduces the effect of the mast as a drag producing bluff body by smoothly conforming the leeward leading edge of the sail to the leeward side of the mast. Camber-inducers and split battens do not operate to move the point of maximum draft of the sail forward to the quarter chord of the sail unless used in conjunction with tapered battens.

U.S. Pat. No. 4,699,073, Farneti, issued Oct. 13, 1987, discloses a double surfaced sail incorporating a rotating batten socket at the mast and conventional tying means for tensioning the trailing ends of the battens into the batten pockets. The double surfaced design of the sail extends on both sides of the sail, from the leading edge back to the trailing edge of the sail. The double surfaced sail as taught by Farneti accomplishes a thicker airfoil than is conventionally attained. Farneti, however, does not teach using the double surfaced sail to move the point of maximum draft of the sail forward from the half chord.

When a sail craft is maneuvered so that its bow is brought across the wind, the sail craft is said to have tacked. Upon tacking, the sail pivots about the mast and, consequently, turns "inside out" due to the windward pressure moving from one side of the sail to the other. A conventional batten must thus reflex with the sail so as to change its curvature from one side to the other. The method of reflexing a conventional batten is illustrated in the Farneti patent (see FIGS. 4, 5 and 6 which illustrate reflexing batten 11). However, in sails having thicker airfoils, such as accomplished by using double surfaced sails, or in conventional sails using tapered battens where the battens are highly tensioned so as to bend the battens into the desired curvature, the battens will not, it has been found, easily reflex. If forced to reflex, such battens will often break.

SUMMARY OF THE INVENTION

A telescopic, flexible sail batten for a mast supported sail comprises first and second batten elements, each of the elements having first and second ends, the second end of the first element and the first end of the second element being nested for telescopic, free-sliding relative movement between extended and retracted positions. A helical coil spring is mounted longitudinally in the batten and acts on the first and second elements of the batten to bias the elements toward an extended position.

Advantageously, a container having an aperture at a first end thereof, for slidably receiving the first end of the second batten element, is inserted in the open end of a longitudinal bore in the second end of the first batten element. The spring is mounted longitudinally in the container. The magnitude of the biasing force of the spring may be controllably adjusted by a screw slidably longitudinally mounted through a second aperture in an opposed end of the container from the first end of the container. The screw threadably cooperates with the first end on the second batten element.

The magnitude of the biasing force of the spring may also be controllably adjusted by inserting a rod into the longitudinal bore. The spring is placed longitudinally in the bore between the rod and the first end of the second batten element.

In one embodiment, the spring is slidably mounted on the first end of the second batten element, between the second end of the first batten element and the second end of the second batten element when the second batten element is nested in the first batten element.

The first end of the first batten element may comprise a split end, or may have mounted thereon a camber inducer for bearing against a mast mounted in a luff pocket in the sail.

In a preferred embodiment of the invention, the first end of the second batten element comprises a cylinder which extends into the bore in the second end of the first batten element. The cylinder bears against the spring mounted in the bore. The cylinder has at its outer end extending from the bore a flared head which is wider in diameter than the bore. The flared head forms a surface for transferring force to the sail.

In the embodiment of the invention where the spring is slidably mounted between the second end of the first batten element and the second end of the second batten element, the spring bears at one end against the rim of the container which is inserted into the bore, and bears at its other end against the shoulder formed by the flared head of the cylinder extending from the bore.

DETAILED DESCRIPTION OF THE PREFERRED EMBODIMENT

An efficient shape for sailboarding airfoils, that is, airfoil shaped sails for use in low airspeed environments, is an airfoil having a greater draft at the quarter chord of the airfoil than is conventionally attained in the sailboarding art, an airfoil having its point of maximum draft at approximately the quarter chord of the airfoil, and an airfoil having leeward and windward surfaces separated by a greater distance than is conventionally attained in the sailboarding art.

Figure 1:
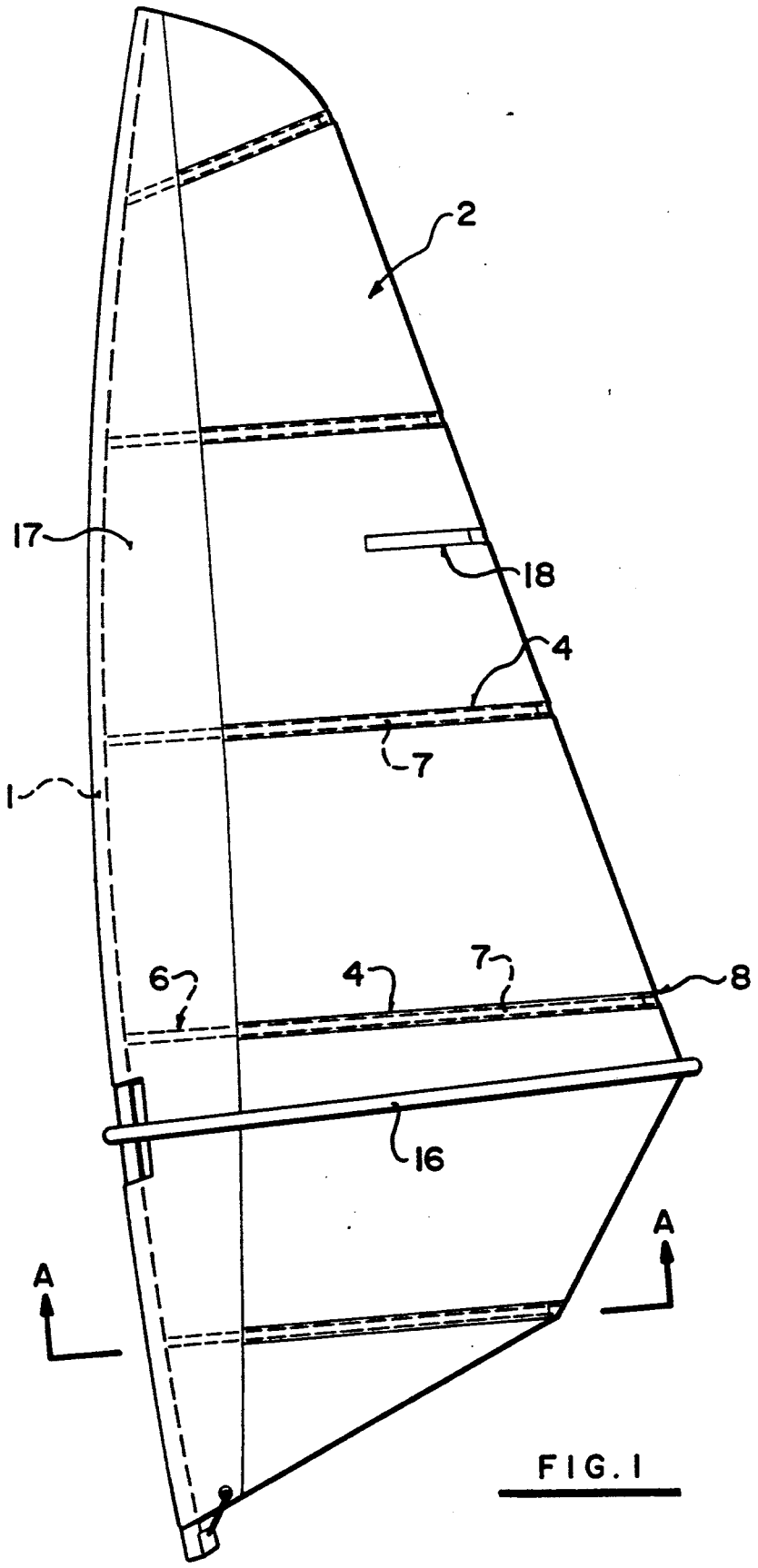
FIG. 1 is a side elevation view of a mast supported windsurfing sail.
Figures 2, 3, 4:
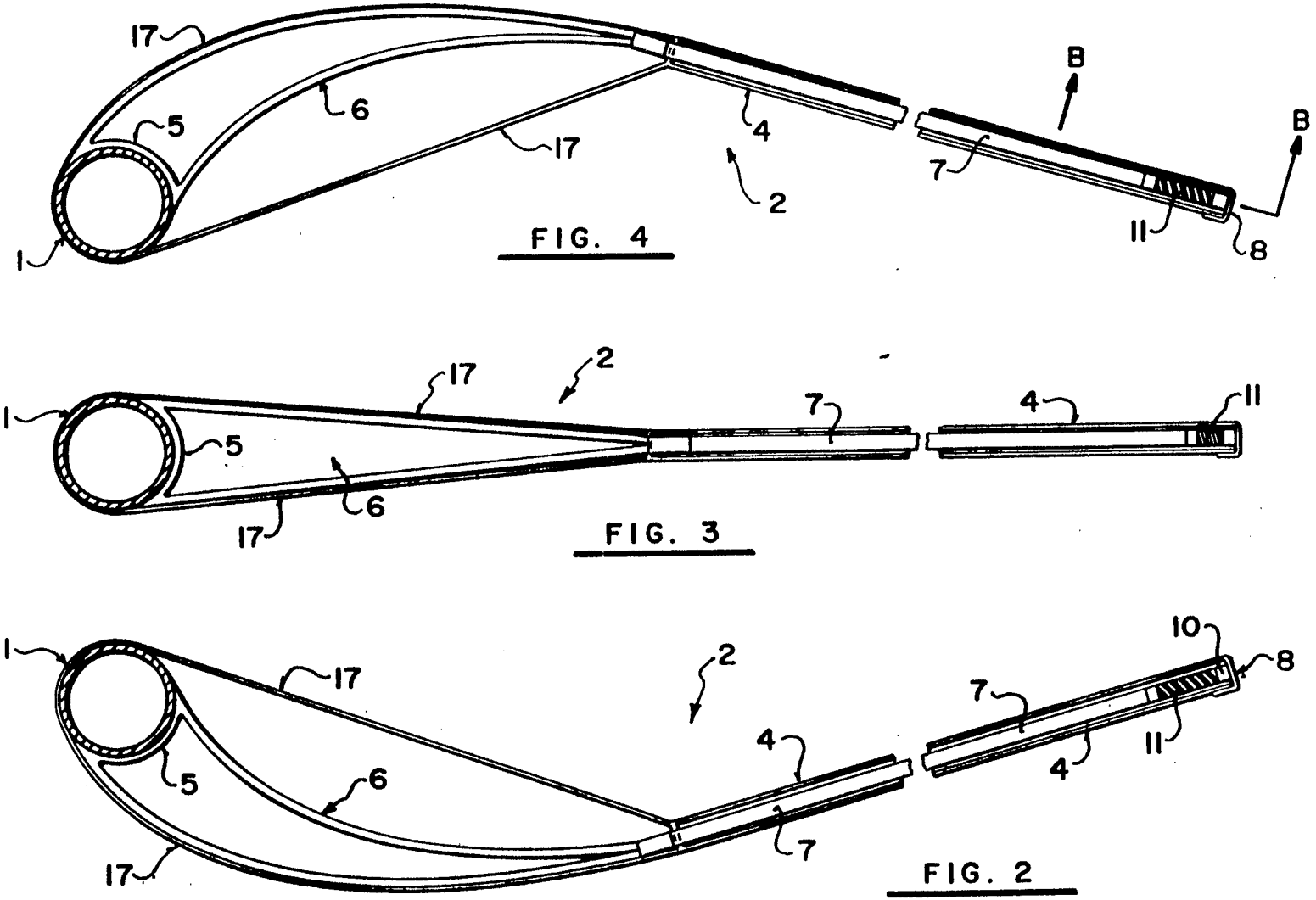
FIG. 2 is a top plan view in cross-section along line A—A in FIG. 1 illustrating a windsurfer sail incorporating the present invention while the windsurfer is on a starboard tack.
FIG. 3 is the cross-section of FIG. 2 illustrating a windsurfer sail incorporating the present invention during a tack, with the sail heading directly into wind.
FIG. 4 is the cross-section of FIG. 2 illustrating a windsurfer sail incorporating the present invention after the windsurfer has tacked onto a port tack.

In the drawings, FIG. 1 illustrates a mast-supported sailboarding sail incorporating the battens of the present invention. Mast 1 supports sail 2. Batten pockets 4 extend generally horizontally and longitudinally along the chord lines of the sail in vertically spaced array. As shown in FIG. 2, batten pockets 4 contain battens 7. In one embodiment, battens 7 may be mounted to mast 1 by incorporating a longitudinally split luff end 6 and mast retainer bracket 5. Mast retainer bracket 5 is free to pivot about mast 1. Luff sleeve 17 is not affixed to either mast 1, bracket 5 or luff end 6, and is thus free to adjust to the movement of batten 7 between opposing tacks. Leach batten pockets 18 may be incorporated into sail 2 in areas requiring extra support, but where a full length batten pocket 4 is not required. Battens (not shown) incorporating the present invention may also be fit into leach batten pockets 18.

Sail 2 has luff sleeve 17. If a sufficiently flexible batten is tensioned into batten pocket 4 (where the pocket extends aft from luff sleeve 17 in the embodiment illustrated in FIGS. 1–4) under sufficient force, luff end 6 will curve to produce increased airfoil draft and curvature at approximately the quarter chord of the sail. However, as best illustrated in FIGS. 2, 3 and 4 batten 7 must be able to shorten longitudinally during tacking because the distance between mast 1 and the trailing edge of luff sleeve 17 (the distance within which luff end 6 must reflex due to the constrainment of luff sleeve 17) is insufficient for luff end 6 to reflex in the normal manner without breaking the batten.

FIGS. 2, 3 and 4 illustrate how spring 11 is compressed so as to shorten the length of batten 7 as sail 2 changes shape between opposing tacks. In moving from one tack to another, boom 16 and sail 2 are rotated about mast 1. Sail 2 thereby momentarily goes flat, shortening batten 7 by compressing spring 11. By the resilient action of spring 11, batten 7 reforms the sail shape on the opposing tack by being returned to its original length in batten pocket 4.

Figure 5:
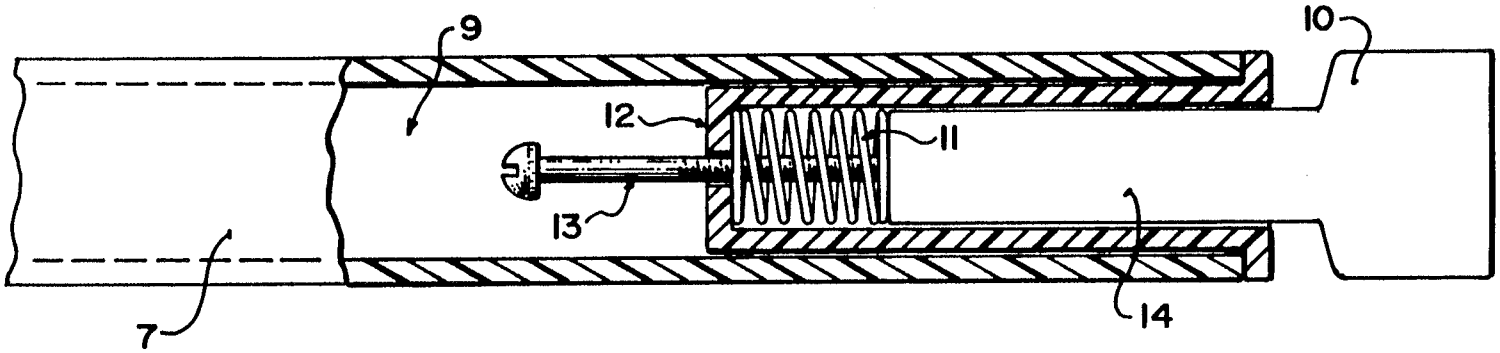
FIG. 5 is a partial cut-away view of a cross-section taken along line B—B of FIG. 4 showing a spring and plunger arrangement of the present invention.
Figure 6:
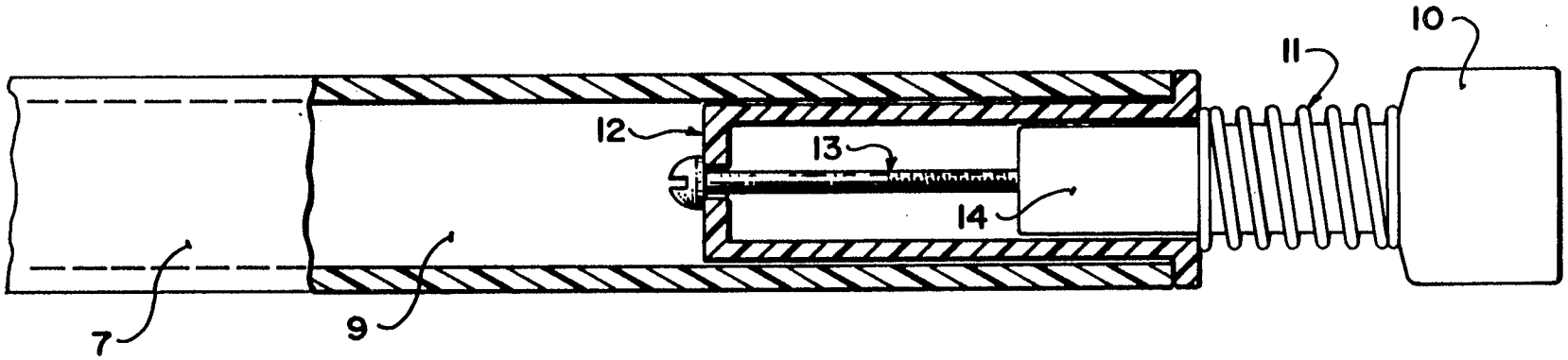
FIG. 6 is a further embodiment of the spring and plunger arrangement of FIG. 5.
Figure 7:
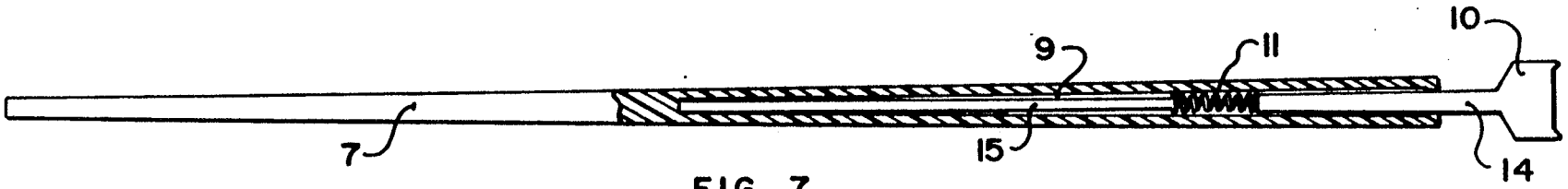
FIG. 7 is a partial cut away view of a batten of the present invention incorporating a further spring and plunger arrangement.

As illustrated in FIG. 5, batten 7 has a longitudinal bore 9 extending longitudinally forward from aft end 8 In one embodiment plunger 10 and spring 11 are mounted adjacently within retainer 12 by means of retaining screw 13. Retainer 12 is inserted into bore 9 in batten 7. In the embodiment illustrated in FIG. 6, spring 11 is mounted externally from retainer 12 along shaft 14 of plunger 10. As illustrated in FIG. 7, in a further embodiment retainer 12 is replaced by rod 15 for retaining spring 11 adjacent plunger 10 in bore 9. Rod 15 is merely slid into bore 9 followed by spring 11 and plunger 10.

For any particular batten pocket length, the force required to compress spring 11 may be adjusted by increasing or shortening the length of rod 15. When a more rigid airfoil is desired, or when an increased amount of curvature is being forced into luff end 6, a rod 15 having an increased length is used so that spring 11 is precompressed when batten 7 is fitted into batten pocket 4. This is accomplished in the embodiments illustrated in FIGS. 5 and 6 by adjusting screw 13 to precompress spring 11.

In further embodiments (not shown) spring 11 might be replaced by an insert of rubber-like material, or a pneumatically actuated insert, or an insert which incorporates surgical tubing in a "slingshot" arrangement so as to provide resilient shortening of batten 7. Also, conventional battens might be adapted to perform in accordance with the present invention by using the present invention merely as a detachable add-on batten element to conventional battens. A sleeve fitted with resilient means such as outlined above would fit onto the end of a shortened conventional batten. The combination would then be inserted into batten pocket 4 or 18.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A telescopic, flexible sail batten for a mast supported sail comprising:

a) first and second batten elements, each of said elements having first and second ends, said second end of said first element and said first end of said second element being nested for telescopic, free-sliding relative movement between extended and retracted positions, said second end of said second element comprising a surface for transferring force to said sail; and, b) biasing means acting on said first and second elements to bias said elements toward an extended position.

2. The batten of claim 1 wherein said biasing means comprises a spring.

3. The batten of claim 2 wherein said spring is slidably mounted on said first end of said second element between said second end of said first element and said second end of said second element.

4. The batten of claim 2 further comprising means for controllably adjusting the magnitude of the biasing force of said spring.

5. The batten of claim 4 wherein said second end of said first batten element has a longitudinal bore therein.

6. The batten of claim 5 wherein said means for controllably adjusting the magnitude of said biasing force comprises a container, said container securably insertable in the open end of said bore and having an aperture at a first end thereof for slidably receiving said first end of said second element and wherein said means for controllably adjusting the magnitude of the biasing force of said spring further comprises a screw means slidably longitudinally mounted through a second aperture in an opposed end from said first end of said container and threadably cooperating with said first end on said second element.

7. The batten of claim 1 wherein said first batten element has a camber inducer mounted on said first end of said first batten element for bearing against a mast mounted in a luff pocket in said sail.

8. The batten of claim 1 wherein said first end of said first batten element comprises a split end.

9. The batten of claim 1 wherein said first batten element comprises a longitudinal bore in said second end thereof and said biasing means comprises a helical coil spring mounted in said bore.

10. The batten of claim 9 further comprising means for controllably adjusting the magnitude of the biasing force of said spring.

11. The batten of claim 10 wherein said means for controllably adjusting the magnitude of the biasing force of said spring comprises a rod mounted in said bore.

12. The batten of claim 10, wherein said means for controllably adjusting the magnitude of said biasing force comprises a spring container, said container securably insertable in the open end of said bore, for supportably containing said spring.

13. The batten of claim 12 wherein said spring container has an aperture in a first end thereof for slidably receiving said first end of said second member when said spring container is mounted in said bore.

14. The batten of claim 13 wherein said means for controllably adjusting the magnitude of the biasing force of said spring further comprises a screw means slidably longitudinally mounted through a second aperture in and end of said container opposed to said first end and threadably cooperating with said first end on said second element.

15. The batten of claim 12 wherein said first batten element has a camber inducer mounted on said first end of said first batten element for bearing against a mast mounted in a luff pocket in said sail.

16. The batten of claim 12 wherein said first end of said first batten element comprises a split end.

17. The batten of claim 9, wherein said second batten element comprises at the first end thereof a cylinder extending into said bore and bearing against said spring in said bore, and a head having outer and inner sides at the second end thereof which is wider in diameter than said bore and forming said surface for transferring force to said sail at the outer side thereof.

18. The batten of claim 5 wherein said second batten element comprises at the first end thereof a cylinder extending into said bore, and a head having outer and inner sides at the second end thereof which is wider in diameter than said bore and forming said surface for transferring force to said sail at the outer side thereof and forming a shoulder against which said spring may bear at the inner side thereof.

19. In a sailboard sail having:

(a) a luff pocket;

(b) a plurality of batten pockets extending across the sail and opening into the luff pocket;

(c) a plurality of battens mounted in the batten pockets and extending into the luff pocket; and, (d) means mounted on one end of the battens for bearing against a mast mounted in the luff pocket, the improvement comprising:

a) said battens each having first and second batten elements, each of said elements having first and second ends, said second end of said first element and said first end of said second element being nested for telescopic, free-sliding relative movement between extended and retracted positions, said second end of said second element comprising a surface for transferring force to said sail; and b) biasing means acting on said first and second elements to bias said elements toward an extended position.

20. The improvement of claim 19 wherein said biasing means comprises a spring.

21. The improvement of claim 20 wherein said spring is slidably mounted on said first end of said second element between said second end of said first element and said second end of said second element.

22. The improvement of claim 20 further comprising means for controllably adjusting the magnitude of the biasing force of said spring.

23. The improvement of claim 22 wherein said second end of said first batten element has a longitudinal bore therein.

24. The improvement of claim 23 wherein said means for controllably adjusting the magnitude of said biasing force comprises a container, said container securably insertable in the open end of said bore and having an aperture at a first end thereof for slidably receiving said first end of said second element and wherein said means for controllably adjusting the magnitude of the biasing force of said spring further comprises a screw means slidably longitudinally mounted through a second aperture in an opposed end from said first end of said container and thereadably cooperating with said first end on said second element.

25. The improvement of claim 19 wherein said means mounted on one end of the battens for bearing against a mast mounted in the luff pocket comprises a camber inducer.

26. The improvement of claim 19 wherein said first end of said first batten element comprises a split end.

27. The improvement of claim 19 wherein said first batten element comprises a longitudinal bore in said second end thereof and said biasing means comprises a helical coil spring mounted in said bore.

28. The improvement of claim 27 further comprising means for controllably adjusting the magnitude of the biasing force of said spring.

29. The improvement of claim 28 wherein said means for controllably adjusting the magnitude of the biasing force of said spring comprises a rod mounted in said bore.

30. The improvement of claim 28, wherein said means for controllably adjusting the magnitude of said biasing force comprises a spring container, said container securably insertable in the open end of said bore, for supportably containing said spring.

31. The improvement of claim 30 wherein said spring container has an aperture in a first end thereof for slidably receiving said first end of said second member when said spring container is mounted in said bore.

32. The improvement of claim 31 wherein said means for controllably adjusting the magnitude of the biasing force of said spring further comprises a screw means slidably longitudinally mounted through a second aperture in and end of said container opposed to said first end and threadably cooperating with said first end on said second element.

33. The improvement of claim 30 wherein said bracket comprises a camber inducer.

34. The improvement of claim 30 wherein said first end of said first batten element comprises a split end.

35. The improvement of claim 27, wherein said second batten element comprises at the first end thereof a cylinder extending into said bore and bearing against said spring in said bore, and a head having outer and inner sides at the second end thereof which is wider in diameter than said bore and forming said surface for transferring force to said sail at the outer side thereof.

36. The improvement of claim 23 wherein said second batten element comprises at the first end thereof a cylinder extending into said bore, and a head having outer and inner sides at the second end thereof which is wider in diameter than said bore and forming said surface for transferring force to said sail at the outer side thereof and forming a shoulder against which said spring may bear at the inner side thereof.

* * * * *